US005235710A

United States Patent [19]

Nagashima

[11] Patent Number: 5,235,710

[45] Date of Patent: Aug. 17, 1993

[54] BED

[75] Inventor: Akira Nagashima, Tokyo, Japan

[73] Assignee: Kioritz Corporation, Tokyo, Japan

[21] Appl. No.: 690,163

[22] Filed: Apr. 22, 1991

[30] Foreign Application Priority Data

Apr. 25, 1990 [JP] Japan ..... 2-109764

[51] Int. Cl.[5] ..... A47K 3/12

[52] U.S. Cl. ..... 4/563.1; 4/566.1; 4/547; 5/614; 5/900

[58] Field of Search ..... 4/566, 565, 564, 563, 4/562, 561, 560, 547, 546, 573, 589, 590; 5/600, 606, 614, 613, 900; 33/512, 514.2

[56] References Cited

U.S. PATENT DOCUMENTS

| | | | |
|---|---|---|---|
| 1,274,851 | 8/1918 | Byrd | 5/613 |
| 1,315,712 | 9/1919 | Evans | 5/600 X |
| 2,112,702 | 3/1938 | Loibl | 5/600 |
| 2,133,587 | 10/1938 | Stark | 4/566.1 |
| 2,560,997 | 7/1951 | Thompson | 4/564.1 |
| 2,968,814 | 1/1961 | Ashby, Jr. | 4/564.1 |
| 3,298,363 | 1/1967 | Parkin | 5/600 |
| 3,561,018 | 2/1971 | McVay | 4/566.1 |
| 4,028,751 | 6/1977 | Moran | 4/565.1 |
| 4,167,793 | 9/1979 | Vago | 4/562.1 |
| 4,407,029 | 10/1983 | Schmidt | 5/900 X |
| 4,982,462 | 1/1991 | Wada | 4/546 |
| 4,999,861 | 3/1991 | Huang | 5/600 |
| 5,101,519 | 4/1992 | Yamamoto | 4/547 X |

FOREIGN PATENT DOCUMENTS

| | | | |
|---|---|---|---|
| 0511050 | 10/1930 | Fed. Rep. of Germany | 5/600 |
| 1041636 | 10/1953 | France | 5/613 |
| 52-32194 | 8/1977 | Japan . | |
| 61-36938 | 8/1986 | Japan . | |
| 0176758 | 10/1961 | Sweden | 5/600 |
| 1009787 | 11/1965 | United Kingdom | 5/600 |
| 2015872 | 9/1979 | United Kingdom | 5/934 |

*Primary Examiner*—William A. Cuchlinski, Jr.
*Assistant Examiner*—John L. Beres
*Attorney, Agent, or Firm*—Bauer & Schaffer

[57] ABSTRACT

A nursing bed having a plurality of mattress sections. Each mattress section is independently adjustable in the vertical direction and tiltable in the lateral direction of the human body.

4 Claims, 3 Drawing Sheets

BED

BACKGROUND OF THE INVENTION

This invention relates to a nursing bed for use by sick and old persons, hereinafter generally referred to as "invalids" and particularly to a bed which provides a comfortable and clean environment for nursing such persons.

The conventional hospital bed is capable of being adjusted only to raise the upper half of the human body. Therefore, extensive effort is required to nurse the invalid particularly when replacing sheets or when the patient is undergoing natural body functions and bathing. When the patient undergoes natural functions a portable toilet or a diaper has had to be used. Such devices are not only inconvenient but highly embarrassing to the sick person. Similar problems exist when bathing.

Various beds for sick persons have been already suggested, for example, in Japanese Patent Application Publications No. 32194/77 and 36938/1986. They are however, not sufficient in overcoming the problem of the invalid or those of the persons nursing them. The known beds require perseverance both the patient and user in maintaining cleanliness.

The present invention, made in view of the above mentioned circumstances, has as an object the provision of a bed which is easily adjustable to conform to the lying posture required by the invalid which can be further adjusted when the patient engages in natural body function or bathing or the like, to facilitate the procedure and make it more comfortable to the invalid. Thus, the patients, well being is heightened, nursing is made easy, and such activity as replacing sheets, wiping the back sides of the invalid or the like are made easy, and the physical and mental labor of the nursing staff is reduced.

BRIEF SUMMARY OF THE INVENTION

The present invention provides a bed wherein the mattress is divided into a plurality of separate sections, each extending in the direction traverse to the body and each of the respective mattress parts are vertically adjustable and tiltable. The mattress sections are disposed in a tub like housing so that bathing may be accomplished. Therefore, the bed can be easily conformed to the posture required by the sick person during treatment and bath.

When raising the upper half of the body, the mattress sections may be elevated so that the patient may be kept inclined. When making the feet high, the mattress section may be elevated.

The respective mattress sections are covered with independent removable sheet covers, the sheet covers will be easily replaced or even partly replaced.

By temporarily elevating the appropriate mattress section, the dirty sheet covers will be able to be easily removed and replaced without giving pain to the invalid. Similarly, cleaning of the invalid can be easily made by inserting the hands below the body while lying as it is.

In easing nature or when required, a toilet may be set on the mattress section on which the hip lies and upper half body may be elevated.

In order to make bathing possible, a bath tub is formed about the periphery of the mattress sections to enclose them. The respective section of the upper half body part are elevated so as to raised it while filling the tub. The bath tub is covered with a nontransparent cover 11. Hot water is fed into the bath tub and body can be washed.

DETAILED DESCRIPTION OF THE INVENTION

Figure 1:
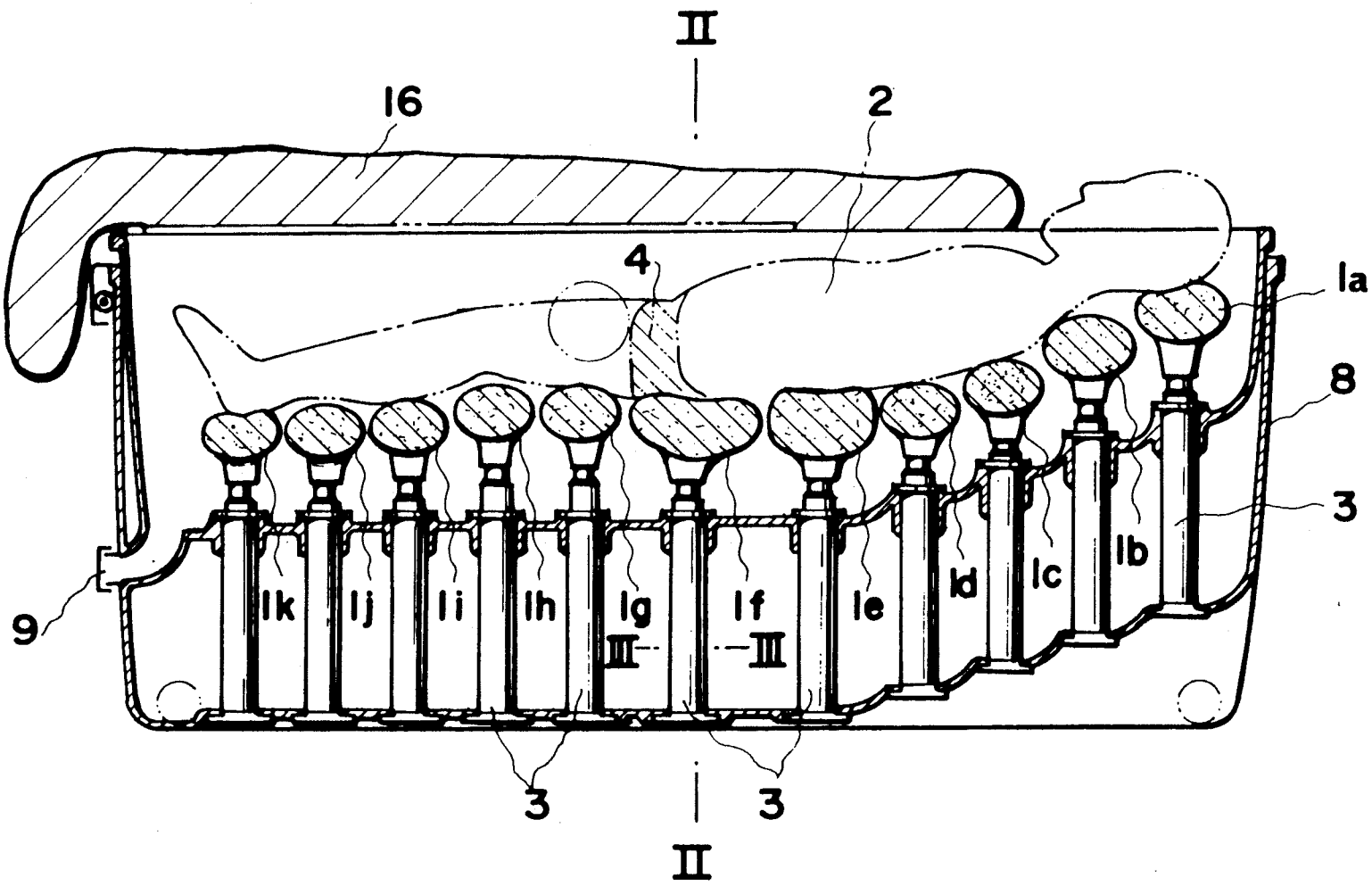
FIG. 1 is a vertically sections view of a invalid bed embodying the present invention.

As seen in the drawings, the bed of the present invention comprises a plurality of mattress sections 1*a* to 1*k* each extending in a direction crossing a human body 2. The mattress sections 1*a* to 1*k* are formed preferably of a material that is porous to air but not water (such as material sold under the trademark Goatex to the Du Pont Co.).

The widths of the respective sections 1*a* to 1*k* are not fixed and are preferably varied to conform to the respective parts of the human body 2 being treated, as seen clearly in FIG. 1.

The mattress sections 1*a* to 1*k* are each constructed so that their height may be selectively adjustable. The mattress sections are each fixed on a retractable supporting tube 3 elevatable by a hydraulic cylinder or motor hoist. The formation of the mattress sections can then be easily arranged to the posture of the invalid lying on the bed. The adjustment of the mattress sections will enable the work of replacing the sheet covers eased since the covers are applied to the independent respective mat parts 1*a* to 1*k* and their replacement is possible without disturbance of the patient.

That is to say, if those mattress sections having the dirty sheet covers are held at their initial height and the other mattress sections (with clean sheets) are elevated a little, the dirty sheet covers will be free and can be easily removed and replaced. Similarly, by controlling the elevation of selected sections the work of wiping the back of the patient can again be easily accomplished, merely by inserting the hands below the patient while the patient remains otherwise on his back on the remaining mattress sections.

A toilet 4 may be set in advance or when required on the mattress section on which the hip is positioned, shown in FIG. 1 as section 1*f* in a similar manner.

Figure 3:
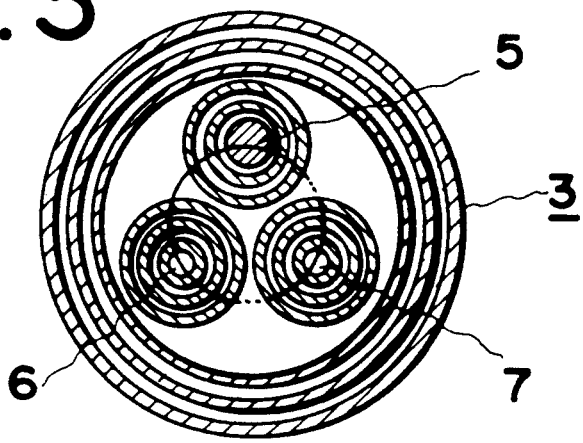
FIG. 3 is a cross-sectional view taken on line III—III of FIG. 1.
Figure 4:
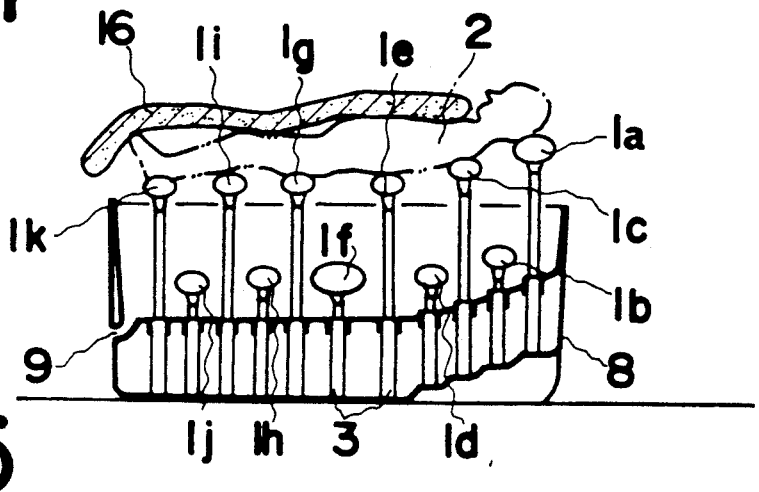
FIGS. 4, 5 and 6 are schematic views showing the manner in which the bed of the present invention is used.

The internal construction of the supporting tube 3 as shown in FIG. 3 comprises a cylinder 5 for elevating the mattress section. A dirt vacuum waste conduit 6 and hot water shower conduit 7 are provided. Each of the conduits is of a multiplex telescoping structure so that, though each is retractable, leakage or the like will not be produced in it and the respective functions may be accomplished.

When setting the toilet 4 as required, a coverlet 16 is applied over the tub and the supporting tube 3 on which the hip sections is to be positioned is left as it is. Thereafter, the other mattress 1*a* to 1*e* and 1*g* to 1*k* are elevated and the toilet 4 is set in place. Finally, the other mat parts 1*a* to 1*e* and 1*g* to 1*k* are lowered bringing the patient to rest on the toilet.

Figure 5:
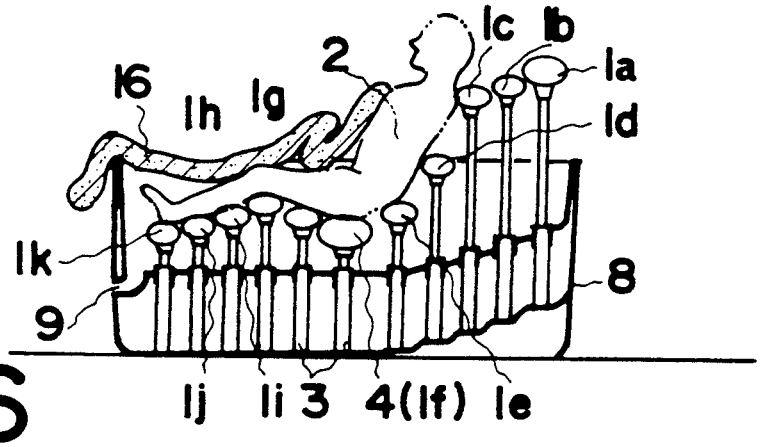

If desired, selective mattress sections 1*a* to 1*e* are elevated to incline the upper half body into a comfortable natural posture. See FIG. 5.

Figure 2:
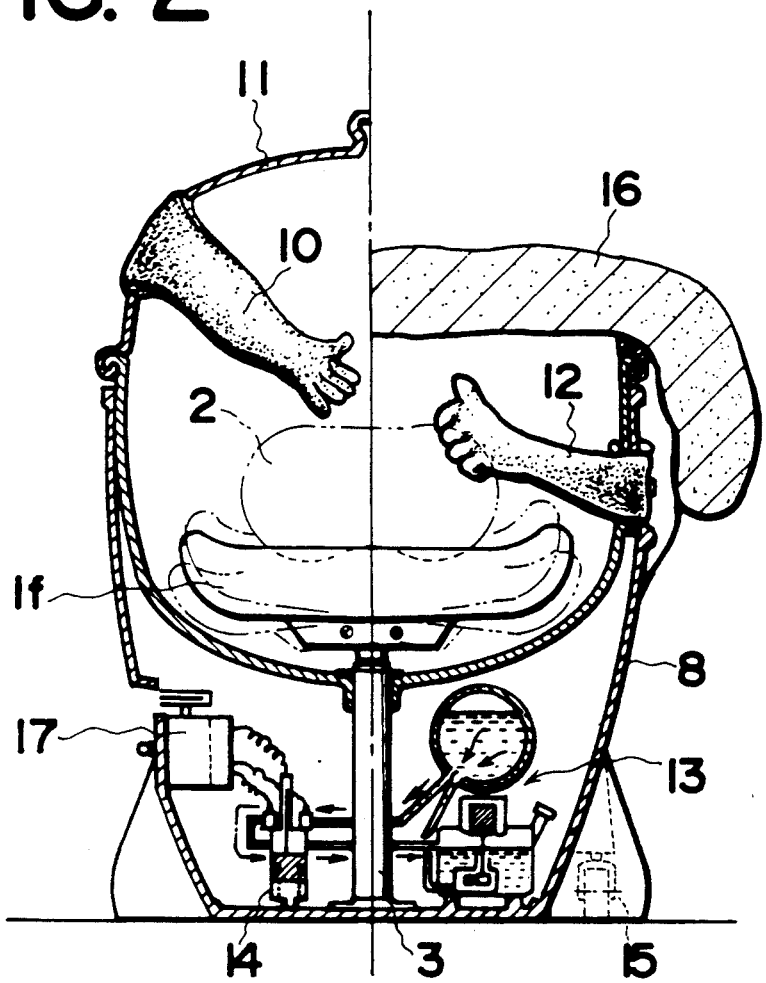
FIG. 2 is a cross-sectional view taken on line II—II of FIG. 1.

Further, as shown in FIG. 2, the respective mattress sections 1*a* to 1*k* are all also inclinable in the lateral direction of the human body 2. The respective mattress sections 1*a* to 1*k* are pivoted to the upper end of the supporting tubes 3 and provided with separate hydraulic cylinders or the like (not illustrated) to be tiltable placing the mattress into selected inclinable positions. This inclinable formation makes it very easy to change the lying posture of the invalid so as to roll the patient over to wipe the back side or to replace the bed clothes or pajama, etc.

Further, in FIGS. 1 and 2, a bath tub 8 is shown, formed about the periphery of the mattress sections. That is to say, the whole bed, including all of the mattress sections 1*a* to 1*k*, is set within a bath tub allowing the patient to be immersed in water for cleaning or for treatment while in the reclining position.

Figure 6:
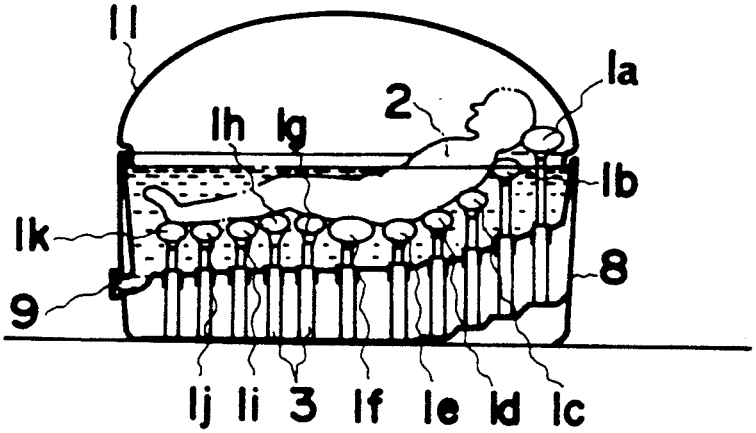

This makes it possible for the invalid to be bathed while lying in the bed, as shown in FIG. 6. The mattress sections 1*a* to 1*e* for the upper half body part are elevated to raise the upper half body. A water draining port 9, is closed and hot water at a proper temperature is fed into the bath tub 8. Thereafter the patient is lowered into the water.

To avoid embarrassing the patient a number of rubber gloves 10 are provided at selected positions and a non-transparent cover 11 having a transparent head part only is applied over the bath tub 8.

In order to prevent any fluid such as oil, from the hydraulic apparatus, leaking into the bath tub 8, pressurized oil is transmitted only to a water pressure cylinder 14 which operates the supporting tubes 3. The mattress sections are extended and retracted only by water pressure so that no oil can contaminate the bath water.

As seen in FIG. 2, the tub 8 is provided with a castor 15, the coverlet 16 and an elevation control mechanism 17 for operating the respective mattress sections 1*a* to 1*k*. The operation of the sections 1*a* to 1*k* may be incorporated in a computer program in advance and may be totally controlled, for example, by inserting an IC card.

According to the present invention, many effects can be obtained such that it is easy to conform to the posture required by the sick person. The physical and mental labors of the nursing person are reduced, a more natural treating of the patient can be easily obtained and embarrassment of the patient reduced.

What is claimed is:

1. A nursing bed comprising a plurality of mattress sections upon which a human body may lie, each section extending transversely to the direction of the human body lying thereon and in parallel spaced relationship with each other, each mattress section being supported on a vertically adjustable support and being laterally inclinable with respect to the direction of the human body.

2. A nursing bed according to claim 1, including a bathtub enclosing said bed and permitting said human body to be lowered into and raised therefrom.

3. The nursing bed according to claim 1, wherein each of said mattress sections is elongated in the transverse direction of the human body and narrow in the direction of the length of the human body to support a discrete portion of the human body.

4. The nursing bed according to claim 1, wherein each of the vertically adjustably supports includes a fluid actuator to raise and lower the associated mattress section independently of each of the other mattress sections.

* * * * *